US008052589B2

(12) United States Patent
Yamaguchi

(10) Patent No.: US 8,052,589 B2
(45) Date of Patent: Nov. 8, 2011

(54) SHEET CONVEYING ROLLER, SHEET CONVEYING APPARATUS, AND IMAGE FORMING APPARATUS

(75) Inventor: Yoshimasu Yamaguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 940 days.

(21) Appl. No.: 11/673,056

(22) Filed: Feb. 9, 2007

(65) Prior Publication Data

US 2007/0194523 A1 Aug. 23, 2007

(30) Foreign Application Priority Data

Feb. 17, 2006 (JP) ..... 2006-041565

(51) Int. Cl.
*B05C 11/00* (2006.01)

(52) U.S. Cl. ..... 492/48; 492/39; 492/25; 271/275

(58) Field of Classification Search ..... 492/18, 492/25, 27, 39, 40, 47, 48; 101/415.1, 442, 101/378, 215; 271/81, 314, 275
See application file for complete search history.

(56) References Cited

U.S. PATENT DOCUMENTS

| | | | | | |
|---|---|---|---|---|---|
| 1,542,221 | A | * | 6/1925 | De Jarnette | 492/39 |
| 2,046,136 | A | * | 6/1936 | St Claire | 492/44 |
| 2,578,761 | A | * | 12/1951 | Sweet et al. | 544/356 |
| 2,730,770 | A | * | 1/1956 | Higginbotham et al. | 15/256.52 |
| 2,878,095 | A | * | 3/1959 | Hackenberg et al. | 346/138 |
| 2,898,854 | A | * | 8/1959 | Crawford | 101/415.1 |
| 3,188,952 | A | * | 6/1965 | Miller | 101/415.1 |
| 3,353,481 | A | * | 11/1967 | Antonucci | 101/93.34 |
| 3,537,632 | A | | 11/1970 | Watson | 226/191 |
| 3,610,121 | A | * | 10/1971 | Hanson et al. | 396/551 |
| 3,710,707 | A | * | 1/1973 | Hanson et al. | 396/559 |
| 3,750,571 | A | * | 8/1973 | Germann | 101/415.1 |
| 4,006,686 | A | * | 2/1977 | Ackerman | 101/415.1 |
| 4,031,600 | A | * | 6/1977 | Whigham | 492/48 |
| 4,061,087 | A | * | 12/1977 | Hill | 101/415.1 |
| 5,219,160 | A | * | 6/1993 | Kemp | 271/275 |
| 5,361,698 | A | * | 11/1994 | Simeth | 101/415.1 |
| 5,473,407 | A | * | 12/1995 | Fuchioka et al. | 355/47 |
| 5,720,212 | A | * | 2/1998 | Kirkpatrick | 83/659 |
| 5,927,202 | A | * | 7/1999 | Hirokawa et al. | 101/415.1 |
| 6,629,482 | B2 | * | 10/2003 | Elia et al. | 83/659 |
| 6,820,529 | B2 | * | 11/2004 | Elia et al. | 83/659 |

(Continued)

FOREIGN PATENT DOCUMENTS

| | | |
|---|---|---|
| GB | 2132737 | 7/1984 |

(Continued)

OTHER PUBLICATIONS

Korean Official Action, dated Dec. 24, 2008.

*Primary Examiner* — David Bryant
*Assistant Examiner* — Jacob Cigna
(74) *Attorney, Agent, or Firm* — Fitzpatrick, Cella, Harper & Scinto

(57) ABSTRACT

A shaft of a sheet conveying roller is a pipe shaft. Both ends of the pipe shaft are formed into small-diameter portions, and a mounted portion on which a friction member is provided is formed into a large-diameter portion, which has a diameter larger than a diameter of the both ends of the pipe shaft.

7 Claims, 6 Drawing Sheets

U.S. PATENT DOCUMENTS 7,007,581 B2 * 3/2006 Elia et al. ..... 83/659

FOREIGN PATENT DOCUMENTS

| | | | |
|---|---|---|---|
| JP | 60-91009 | | 5/1985 |
| JP | 60091009 | A * | 5/1985 |
| JP | 61-18663 | | 1/1986 |
| JP | 63-37065 | | 2/1988 |
| JP | 63-57441 | | 3/1988 |
| JP | 1-256440 | | 10/1989 |
| JP | 03-196993 | | 8/1991 |
| JP | 05-031977 | | 2/1993 |
| JP | 6-92489 | | 4/1994 |
| JP | 8-91599 | | 4/1996 |
| JP | 8-91616 | | 4/1996 |
| JP | 08-099738 | | 4/1996 |
| JP | 11-20979 | | 1/1999 |
| JP | 11-151764 | | 6/1999 |
| JP | 11-165361 | | 6/1999 |
| JP | 2003-176070 | | 6/2003 |
| JP | 2005-170568 | | 6/2005 |

* cited by examiner

SHEET CONVEYING ROLLER, SHEET CONVEYING APPARATUS, AND IMAGE FORMING APPARATUS

BACKGROUND OF THE INVENTION

1. Field of the Invention

The present invention relates to a sheet conveying roller for conveying a sheet, a sheet conveying apparatus having the sheet conveying roller, and an image forming apparatus having the sheet conveying roller.

2. Description of the Related Art

Conventionally, a sheet conveying roller is provided in an image forming apparatus, a printer, a sheet processing apparatus for processing sheets, an image reading apparatus for reading originals, and a sheet handling apparatus, such as sheet conveying apparatus for conveying sheets, mounted in these apparatuses to convey sheets. The image forming apparatus specifically includes a printer, a copier, a facsimile, and a combined machine of them.

The sheet conveying roller includes a shaft supported by a bearing at both ends thereof, and a rubber roller as an elastic friction member mounted on outer circumference of the shaft, thus conveying the sheet by the rubber roller portion. The friction member may use a resin, which has equivalent friction factor with that of the rubber roller.

The shaft of the sheet conveying roller is a solid shaft finished by machining and polishing. The solid shaft is machined by lathe to give center drilling at the end thereof, cutting off and chamfering at each end thereof, and cutting step for a stepped shaft. Furthermore, the sold shaft is provided with a tightening groove or the like thereon by milling. In addition, the solid shaft is subjected to cutting to form a D-shaped cross section by a surface grinder, to drilling for arranging parallel pins by a drilling machine, and to polishing on the outer circumference by a polishing machine. Plating may further be applied in some cases. Thus machined solid shaft as a shaft single body is finished by directly baking rubber or by adhering a rubber roller thereon, followed by polishing the outer circumference of the rubber roller portion to obtain the sheet conveying roller.

The shaft of the sheet conveying roller uses a pipe shaft in some cases. The pipe shaft is prepared by introducing a hoop material of metallic thin belt of stainless steel, aluminum, iron, copper into a drawing die to curl the hoop material in the transversal direction thereof to form a cylindrical shape, followed by butting both ends of the curled portions to seamless-weld them into a shape of a pipe. The pipe shaft is cut to a specified length, as needed, to obtain a base pipe. The base pipe is drawn through a die into a specified outer shape. After correcting the bend of the pipe, the pipe shaft is treated by centerless polishing to a high precision outer diameter (Refer to Japanese Patent Application Laid-Open No. H11-165361).

The pipe shaft may be manufactured by what is called the drawing in which a metal is drawn by spinning, swaging, or pressing. The drawing allows the cylindrical pipe to vary the diameter along the longitudinal direction.

For using thus prepared pipe as the shaft of the sheet conveying roller, the pipe is cut to a specified length, and a stepped boss prepared by machining is integrally fixed to each end of the pipe by press-fitting, friction welding, caulking, or the like. Then, the pipe shaft is machined on the outer circumference thereof centering on the stepped boss to align the pipe shaft with the stepped boss, thus attaining a shaft free from an eccentric motion.

In some cases, a thick-walled pipe is subjected to high precision coaxial machining by lathing on the inner diameter at both ends, and an axial shaft with flange is fixed to each end thereof. Then, the polishing is given on the outer circumference of the pipe centering on the axial shaft at both ends to manufacture a stepped shaft with accurate alignment. The shaft is mounted in a mold of a rubber molding machine to bake a rubber to form a rubber roller thereon, followed by polishing the outer diameter of the rubber roller to assure accuracy of circle and alignment, thus obtaining the sheet conveying roller.

When the sheet conveying roller is used in a sheet conveying apparatus, a rubber roller is mounted at almost center of the shaft, or rubber rollers are arranged along the shaft at a certain interval, and, in some cases, further a bearing is mounted at each end of the shaft, while a gear and a pulley may be mounted at one end thereof. As described above, the conventional sheet conveying roller is manufactured by a plurality of machining processes. Accordingly, the conventional sheet conveying roller has problems of taking the large number of steps for manufacturing and of consuming machining time and cost.

The conventional sheet conveying roller also has problems that, in the step of baking the rubber, the heating of shaft takes a time to delay the molding cycle, which increases the molding cost and increases the energy consumption.

According to the conventional sheet conveying roller, if the shaft is a solid shaft, the mass is heavy and the inertia is large so that the starting time and stopping time of rotation take a long time.

Although the solid shaft has rigidity, the necessary rigidity is only a degree to attain the nipping and conveying force for a thin and light sheet. The conveying force, however, differs with the place of using the sheet conveying roller. For example, at the duplex sheet feeding portion and the retarding sheet feeding portion in a sheet feeder installed in an image forming apparatus, a separation pressure is required, while some of them require only a low separation pressure. The roller to feed a sheet from a cassette, or the registration roller to correct the skew feed of the sheet in the sheet feeder need a conveying force of a degree to override the stiffness of the sheet. On the other hand, the sheet conveying roller plays a role of bridging the sheet in the sheet conveying path, and the sheet conveying roller is subjected to relatively light load, thus the nipping pressure between the sheet conveying rollers is set to a low level in some cases.

Generally a hollow pipe is weaker in deflection than the solid pipe, and the hollow pipe is not welcomed to sheet feeding which requires reliability.

When the solid shaft is used in a sheet conveying roller, which requires only a relatively low strength, the diameter is reduced to save the material cost in some cases. Even if the shaft diameter is reduced, however, the friction roller is required to have a certain diameter. That is, in the sheet conveying section, to guide a curled sheet smoothly to a nip of the sheet conveying roller pair, there are required a certain gap in the sheet conveying path and a certain roller diameter. Those variables significantly affect the sheet conveying performance. When the diameter of the friction roller is reduced, the curled sheet becomes difficult to enter the nip of the sheet conveying roller pair, which causes the skew feed and jamming in the sheet conveying path.

Consequently, even when the outer diameter of the solid shaft is reduced, the outer diameter of the friction roller has to be increased to some extent. As a result, the material cost of the friction roller increases to increase the total cost. To this point, the conventional sheet conveying roller is not provided with the rubber roller thereon over a wide range in the longitudinal direction of the shaft for the case of being mounted in a sheet conveying path, but is provided with the rubber rollers in parts of the shaft at an interval along the longitudinal direction of the shaft to save the material cost of the rubber roller.

Regarding the functions practically required for the sheet conveying roller, the shaft is requested to rotate the rubber roller, to be supported at both ends thereof, and to hold gear, pulley, and the like in the drive transmission mechanism. Similarly, the rubber roller is requested to keep the friction force to surely handle the sheet, and even under abrasion, to keep the sheet conveying speed and friction force within a certain abrasion range. The shaft is not necessarily a solid shaft, and the rubber roller as the friction member does not need a large thickness.

Accordingly, there has been waited a lightweight sheet conveying shaft in which the shaft is a pipe shaft, and the thickness of the friction member more than it seems to be necessary is not required.

SUMMARY OF THE INVENTION

The present invention provides a lightweight sheet conveying roller in which the shaft is a pipe shaft, and the thickness of the friction member more than it seems to be necessary is not required.

The present invention also provides a sheet conveying apparatus having a lightweight sheet conveying roller, thus increasing the sheet conveying efficiency.

Furthermore, the present invention provides an image forming apparatus, which has a lightweight sheet conveying roller to increase the sheet conveying efficiency.

The sheet conveying roller according to the present invention includes a shaft supported at both ends thereof by the respective bearings and an elastic friction member mounted on the outer circumference of the shaft, thereby conveying the sheet at a portion of the friction member. The shaft is a pipe shaft, and both ends of the pipe shaft are formed into small-diameter portions, while the mounted portion on which the friction member is mounted is formed into a large-diameter portion having a diameter larger than that of both ends.

The sheet conveying apparatus according to the present invention conveys the sheet by the sheet conveying roller, which sheet conveying roller is the above sheet conveying roller.

The image forming apparatus according to the present invention includes an image forming portion for forming an image on the sheet, and a sheet conveying roller for conveying the sheet, which sheet conveying roller is the above sheet conveying roller.

The sheet conveying roller according to the present invention adopts a pipe shaft as the shaft, and the friction member is mounted on the large-diameter portion of the pipe shaft. Accordingly, the thickness of the friction member can be made into the minimum required thickness in anticipation of an abrasion. As a result, the sheet conveying roller saves the material for the friction member to decrease the cost. Also, the sheet conveying roller becomes light in weight.

The sheet conveying apparatus according to the present invention is provided with a lightweight sheet conveying roller, thus increasing the sheet conveying efficiency.

The image forming apparatus according to the present invention has a lightweight sheet conveying roller to increase the sheet conveying efficiency. Since the image forming apparatus of the present invention has a lightweight sheet conveying roller, the apparatus can achieve stable image, high image quality, and stable image formation. Furthermore, the image forming apparatus according to the present invention can improve the maintenance performance, reduction in apparatus weight, reduction in weight of driving source owing to the reduction in the driving torque resulting from reduced load, and reduction in the power consumption.

Further features of the present invention will become apparent from the following description of exemplary embodiments with reference to the attached drawings.

DESCRIPTION OF THE EMBODIMENTS

A sheet conveying roller, a sheet conveying apparatus, and an image forming apparatus according to the embodiments of the present invention will be described below referring to the accompanying drawings. The dimensions, material, shape, and relative positioning of the structural components described in the embodiments do not limit the scope of the present invention to those described ones unless otherwise noted.

(Image Forming Apparatus)

The structure of an image forming apparatus will be described below.

Figure 1:
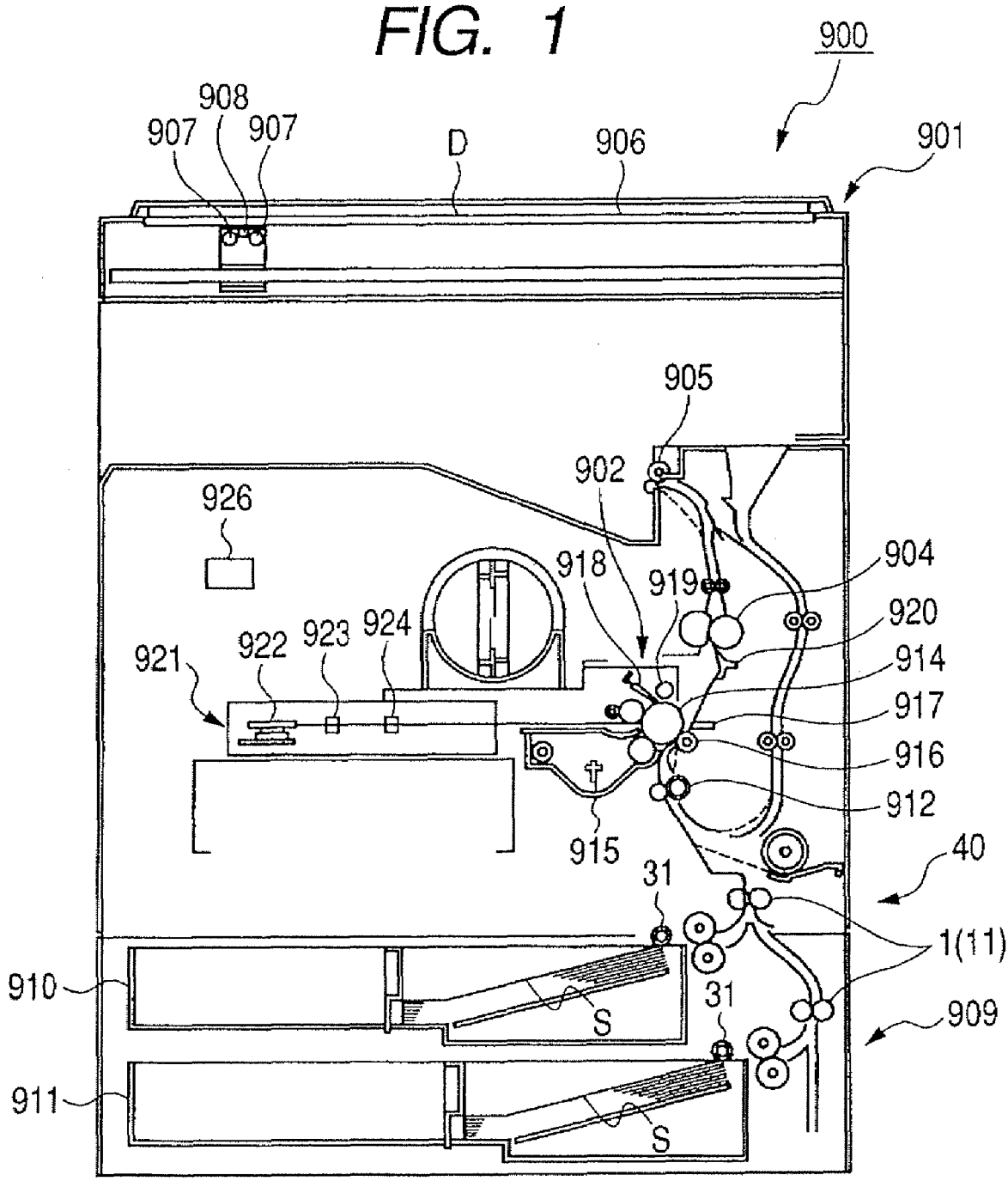
FIG. 1 is a cross sectional view taken along the sheet conveying direction of an image forming apparatus in an embodiment of the present invention.

FIG. 1 is a cross sectional view taken along the sheet conveying direction of an image forming apparatus in an embodiment of the present invention. The image forming apparatus specifically includes a printer, a copier, a facsimile, and a combined machine of them. An apparatus main body 901 of an image forming apparatus 900 includes an original placement table 906, a light source 907, a reader element (CIS: contact image sensor) 908, a sheet feeding portion 909, and an image forming portion 902.

The sheet feeding portion 909 has cassettes 910 and 911, which contain sheets S and are detachably mountable to the apparatus main body 901. Each of the cassettes 910 and 911 is provided with a sheet conveying roller 31. The sheet conveying roller 31 has a portion formed into a D-shape in cross section as illustrated in FIG. 5D.

In the image forming portion 902, a cylindrical photosensitive drum 914, a developing device 915, a transfer charger 916, a separation charger 917, a cleaner 918, and a primary charger 919 are arranged. ON the downstream side of the image forming portion 902, there are arranged a conveying guide 920, a fixing device 904, and a discharge roller pair 905.

A sheet conveying apparatus 40 is provided in the apparatus main body 901. The sheet conveying apparatus 40 has a sheet conveying roller 1 (11).

The function of the image forming apparatus will be described below.

When a controller 926 provided in the apparatus main body 901 generates a sheet feed signal, the light source 907 irradiates light onto the original D placed on the original placement table 906. The reflected light is converted into an electric image signal via the reader element 908. The electric image signal is then sent to a laser scanner 921, and a laser emission element (not shown) emits laser light to irradiate the photosensitive drum 914 via a polygonal mirror 922 and lenses 923 and 924.

The photosensitive drum 914 is charged in advance by the primary charger 919. When a light is irradiated to the photosensitive drum 914, a static latent image is formed on the photosensitive drum 914. The static latent image is subjected to toner-developing by the developing device 915 to become a visualized image as a toner image.

The sheet S fed from the sheet feeding portion 909 is corrected in the skew feed thereof by a registration roller 912, and, after being adjusted in timing, is fed to the image forming portion 902. In the image forming portion 902, the transfer charger 916 transfers the toner image on the photosensitive drum 914 to the sheet S. The sheet S onto which the toner image has been transferred is charged to reverse polarity from the polarity of the transfer charger 916 by the separation charger 917, thus separated from the photosensitive drum 914.

The sheet S separated from the photosensitive drum 914 is conveyed to the fixing device 904 by the conveying guide 920. The fixing device 904 heats and presses the sheet S to permanently fix the toner image onto the sheet. Then, the sheet S on which the toner image is fixed is discharged from the apparatus main body 901 by the discharge roller pair 905.

(Sheet Conveying Roller of the First Embodiment)

Figure 2A:
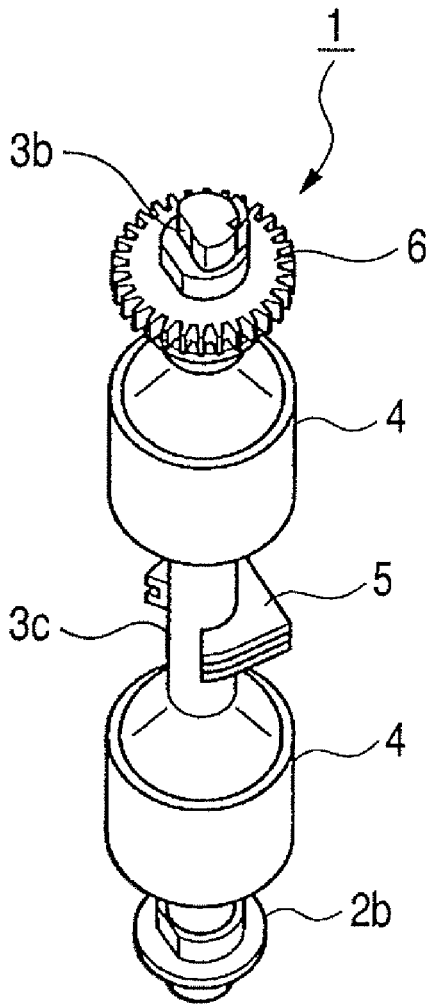
FIG. 2A is a perspective view of a sheet conveying roller of a first embodiment.
Figure 2B:
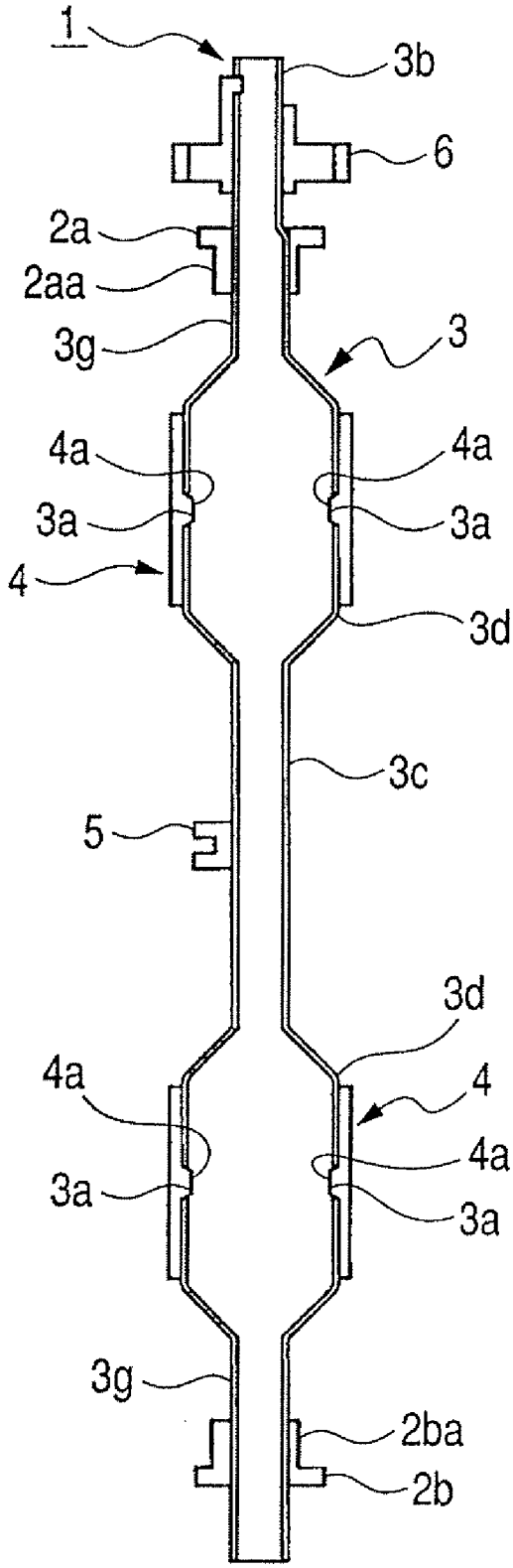
FIG. 2B is a cross sectional view taken along the axial direction of the sheet conveying roller of the first embodiment.

FIGS. 2A and 2B illustrate the sheet conveying roller of the first embodiment, mounted in the image forming apparatus 900 of the present invention. FIG. 2A is a perspective view of the sheet conveying roller of the first embodiment. FIG. 2B is a cross sectional view taken along the axial direction of the sheet conveying roller of the first embodiment.

Regarding the sheet conveying rollers 11, 21, and 31 in the respective second, third, and fourth embodiments, the components designated by the same numerals or symbols as those in the sheet conveying roller of the first embodiment have similar structures, and further description thereof are omitted.

In order to convey sheets, the sheet conveying roller is mounted on an image forming apparatus, a printer, a sheet processing apparatus for processing sheets, an image reading apparatus for reading originals, and a sheet handling apparatus, such as a sheet conveying apparatus for conveying sheets, mounted on these apparatuses. The sheet conveying roller can also be used as the roller supporting a belt of a belt conveyer. Therefore, the sheet conveying roller is applicable not only at the place of sheet conveying but also at places supporting the article to be conveyed.

The sheet conveying roller 1 is structured by a pipe shaft 3 as the shaft, a rubber roller 4 as the friction member, bearings 2*a* and 2*b*, and a gear 6. The bearings 2*a* and 2*b* and the gear 6 are not necessarily provided.

Regarding the pipe shaft 3, a cylindrical pipe made of stainless steel such as SUS304 having a uniform thickness wall is shaped to form a constriction 3*c* as the intermediate small-diameter portion, while leaving a large-diameter portion 3*d* as the mounted portion. Then, a die is inserted into each end of the pipe, followed by pressing the pipe to form an opening hole 3*a* in the large-diameter portion 3*d*. The opening hole 3*a* is formed to communicate the inner side with the outer side of the pipe shaft 3. After that, the pipe shaft 3 is subjected to drawing from both ends thereof, while leaving the large-diameter portion behind, to form a small-diameter portion 3*g* at each end with a required diameter. The drawing is done by spinning, swaging, and pressing to reduce a part of the outer shape.

Then, to the opening hole 3*a* as the engaged portion formed on the large-diameter portion 3*d*, the tube-shaped rubber roller 4 is mounted. The rubber roller 4 is mounted by mating a projection 4*a* as the engaging portion formed on the inner surface of the rubber roller 4 with the opening hole 3*a*, then pushing the projection 4*a* into the opening hole 3*a*. Thus, the inner surface of the rubber roller 4 and the outer circumferential surface of the pipe shaft 3 can have the mounting force enough against the sheet conveying force. That is, by inserting the projection 4*a* into the opening hole 3*a*, the rubber roller 4 is locked by the pipe shaft 3. The rubber roller 4 may be a resin instead of rubber. The rubber roller 4 may be a coating layer illustrated in FIGS. 3A and 3B.

To the constriction 3*c*, there is fitted a sliding member 5 as a support member by snap-fitting. The sliding member 5 is a plastic molded article made of a material suitable for a bearing, such as polyoxymethylene (POM) and polyamide (PA), selected depending on the strength of the constriction 3*c*. The sliding member 5 serving as a bearing is provided on a fixing member of the image forming apparatus main body to bear the conveying pressure force being applied when the sheet conveying roller 1 conveys the sheet.

When the constriction 3*c* has a strength enduring the conveying pressure force, the constriction 3*c* is not necessarily supported by the sliding member 5. The pipe shaft 3 may have three or more of large-diameter portions 3*d* or may have two or more of constrictions 3*c*, or may have no constriction 3*c* and have only one large-diameter portion 3*d*.

On the small-diameter portion 3*g* of the pipe shaft 3, there are mounted bearings 2*a* and 2*b*, in a sliding manner, made of a plastic molded article, suitable for the bearing, such as that of polyoxymethylene (POM) and polyamide (PA), and an oil-impregnated metal made of sintered metal. The bearings 2*a* and 2*b* may be press-fitted into an inner race of the bearing. In this case, the bearings 2*a* and 2*b* may be integrally formed with the small-diameter portion 3*g* of the pipe shaft 3. Alternatively, the small-diameter portion 3*g* may be press-fitted into the inner race of the bearing.

The small-diameter portion 3*g* of one end of the pipe shaft 3 has an attached portion 3*b* being formed by press working into a D-shaped cross section. The gear 6 is fitted onto the attached portion 3*b* and is held by snap-fitting. The gear 6 is connected to the drive source of the image forming apparatus via a gear train and a belt, and the drive is transmitted to rotate the pipe shaft 3.

The characteristics of the above-described sheet conveying roller will be described below.

The conventional sheet conveying roller is manufactured by mounting, direct baking, or bonding a rubber on the surface of a solid shaft having straight shape with a small-diameter to decrease the weight of the roller. Consequently, to make the rubber roller have a specified diameter, the thickness of the rubber roller increases, thus increasing the cost. If the diameter of the rubber roller is decreased to decrease the weight of the sheet conveying roller, the abrasion of the rubber roller increases, and the curled sheet comes over the roller to cause jamming. Consequently, the rubber roller generally has to have a specified diameter.

To the contrary, the sheet conveying roller 1 of the embodiment adopts the pipe shaft 3 as the shaft, and the large-diameter portion 3*d* of the pipe shaft 3 allows the rubber roller 4 to mount thereon. Therefore, the thickness of the rubber is reduced to a requisite minimum thickness in anticipation of an abrasion. As a result, the sheet conveying roller 1 saves the rubber material of the rubber roller to decrease the cost. In addition, the sheet conveying roller 1 becomes light in weight.

Furthermore, since the small-diameter portion 3*g* at each end of the pipe shaft 3 is drawn to a small diameter, the circumferential speed of sliding rotary surfaces 2*aa* and 2*ba* at outer circumference of the bearings 2*a* and 2*b*, respectively, can be reduced. As a result, the PV value of the sheet conveying roller 1 can be decreased to reduce the abrasion of the bearings 2*a* and 2*b*. In addition, the bearing becomes small in size to reduce the material cost, and the weight reduction reduces the cost.

Note that the P of PV value is the force with which the sheet conveying roller presses the sheet, and V is the rotational circumferential speed of the bearing portion of the sheet conveying roller. Even when the P value does not vary, the V value decreases so that the PV value decreases as a result.

Further, regarding the sheet conveying roller 1, the pipe shaft 3 is covered by the rubber roller 4 only at a portion necessary to convey the sheet. Therefore, the weight of the sheet conveying roller 1 becomes small to reduce cost.

For the sheet conveying roller 1, the constriction 3*c* is formed on the pipe shaft 3. Consequently, when a sheet guide member (not shown) is positioned at the constriction 3*c*, the sheet is surely guided.

Furthermore, since the constriction 3*c* of the sheet conveying roller 1 contacts with the sliding member 5, the sliding member 5 bears the sheet conveying pressure force applied to the sheet conveying roller 1 during the sheet conveyance. The sliding member 5 endures the impact force generated by the sheet entering into the nip of the sheet conveying roller pair, the variations of nipping pressure of the sheet conveying roller pair depending on the sheet thickness, the impact force generated by the rear end of the sheet leaving from the sheet conveying roller pair, and other forces. As a result, the sheet conveying roller 1 can convey the sheet in a stable state.

By inserting the projection 4*a* of the rubber roller 4 into the opening hole 3*a* of the pipe shaft 3 formed by the fuss-free press working, the rubber roller 4 is mounted on the pipe shaft 3. Thus the mounting of rubber roller 4 is conducted also at a low cost.

(Sheet Conveying Roller of the Second Embodiment)

Figure 3A:
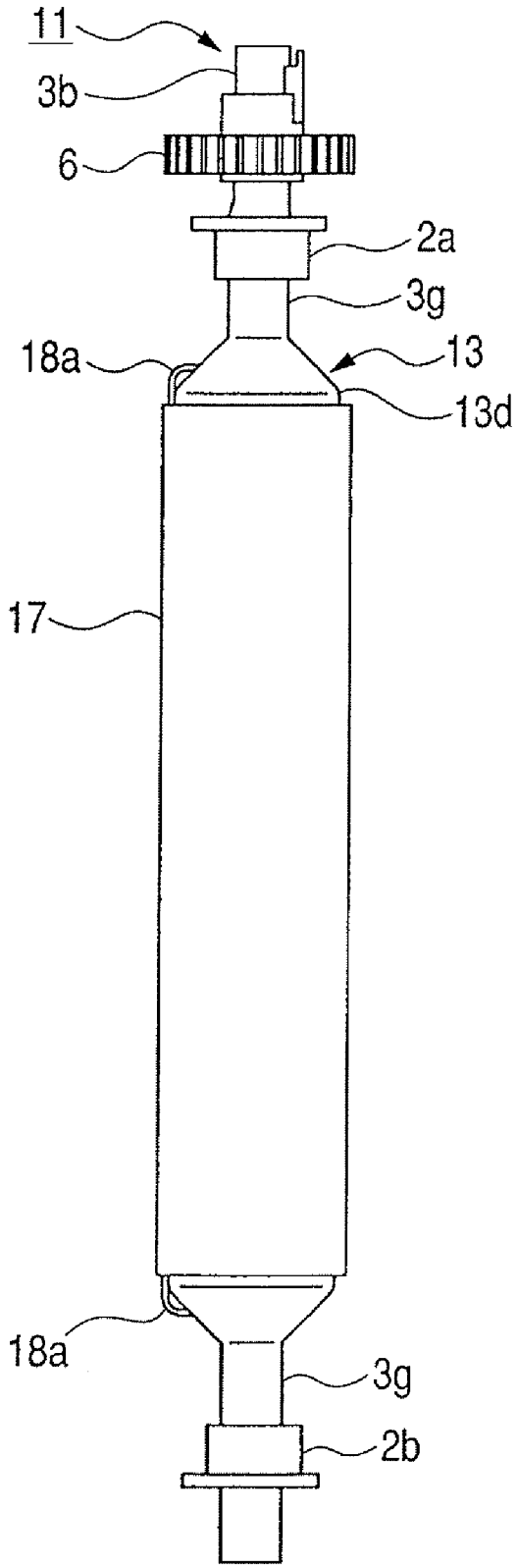
FIG. 3A is a plan view of a sheet conveying roller of a second embodiment.
Figure 3B:
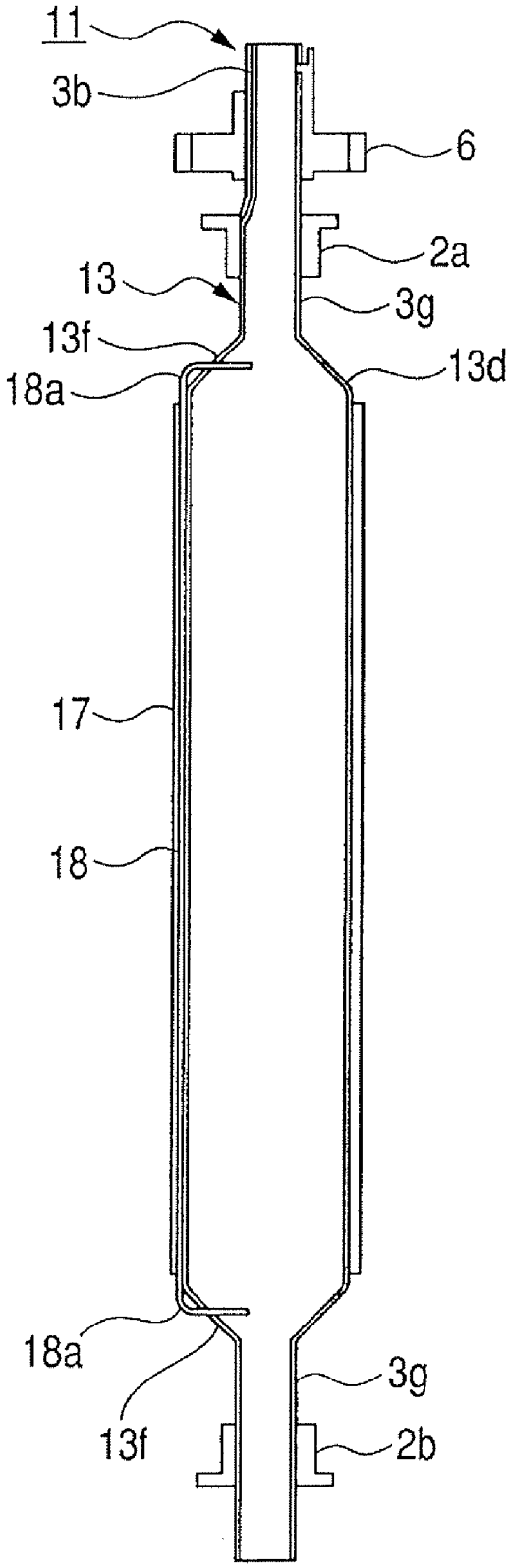
FIG. 3B is a cross sectional view taken along the axial direction of the sheet conveying roller of the second embodiment.

FIGS. 3A and 3B illustrate the sheet conveying roller of a second embodiment. FIG. 3A is a plan view of the sheet conveying roller of the second embodiment. FIG. 3B is a cross sectional view taken along the shaft direction of the sheet conveying roller of the second embodiment.

A sheet conveying roller 11 is structured by a pipe shaft 13 as the shaft, a coating layer 17 as the friction member, a wire 18, the bearings 2*a* and 2*b*, and the gear 6. The bearings 2*a* and 2*b* and the gear 6 are not necessarily provided.

The sheet conveying roller 11 of the embodiment has a structure, which is easy to strip the coating layer 17 to enable the pipe shaft 13 to be recycled.

Regarding the pipe shaft 13, a cylindrical pipe made of stainless steel such as SUS304 having a uniform wall thickness is drawn only at both ends thereof, while leaving the large-diameter portion 13*d* behind as the mounted portion, to form the small-diameter portion 3*g* at both ends of the shaft. To the large-diameter portion 3*d*, the coating layer 17 formed by coating a high friction material thereon is provided. The material of the coating layer 17 is rubber or resin. The large-diameter portion 13*d* may be a tube-shaped rubber roller as illustrated in FIG. 2 instead of the coating layer 17.

The coating layer 17 is formed to have a thickness necessary for durable in use life. That is, the thickness of the coating layer 17 is selected to attain the outer circumferential length of the coating layer 17 within an allowable error range of sheet conveying speed even if the coating layer 17 is abraded to some extent.

After using and when discarding the sheet conveying roller 11 of the embodiment, the wire 18 as a tear member is positioned between the coating layer 17 and the large-diameter portion 13*d* to tear the coating layer 17 by pulling the wire 18 in the direction away from the large-diameter portion 13*d* so as to separate the materials. Instead of the wire, a thin metal tape or plastic tape may be used.

The wire 18 has a length extending outward from the large-diameter portion 13*d* of the pipe shaft 13, and has an end portion 18*a* bent at about a 90-degree angle. During the manufacturing of the sheet conveying roller 11, the end portion 18*a* of wire 18 is inserted into a wire insertion hole 13*f* on the pipe shaft 13 before coating the coating layer 17 onto the large-diameter portion 13*d*. After that, the coating layer 17 is coated onto the large-diameter portion 13*d*. As a result, the wire 18 is held between the coating layer and the large-diameter portion 13*d*.

Similar to the sheet conveying roller 1 of the first embodiment, the sheet conveying roller 11 of the second embodiment can save the rubber material of the rubber roller to reduce the cost and the weight. The abrasion of the bearings 2*a* and 2*b* can be reduced. In addition, the size of bearing can be reduced to save the material, which can also reduce the weight and the cost.

Further, when the sheet conveying roller 11 of the embodiment is disassembled after a long period of operation, pulling a wire 18 from the end portion of the roller 11 tears the coating layer 17 to separate thereof. Thus the coating layer 17 can readily be separated from the pipe shaft 13, and the pipe shaft 13 is recyclable. Even when the thickness of the coating layer 17 is at a level difficult to be stripped as in the case of the related art, the coating layer 17 can be readily torn. The coating layer 17 is designed to a minimum thickness to attain the outer circumferential length of the coating layer 17 to assure the allowable error range of the sheet conveying speed even if the coating layer 17 is abraded to some extent. Therefore, the coating layer 17 can be easily torn. Incidentally, the thickness of the coating layer 17 is about 1 mm. Instead of the coating layer 17, when a tube-shaped rubber roller is mounted on the large-diameter portion 13*d*, as illustrated in FIG. 2, the rubber roller can easily be removed.

(Sheet Conveying Roller of the Third Embodiment)

Figure 4A:
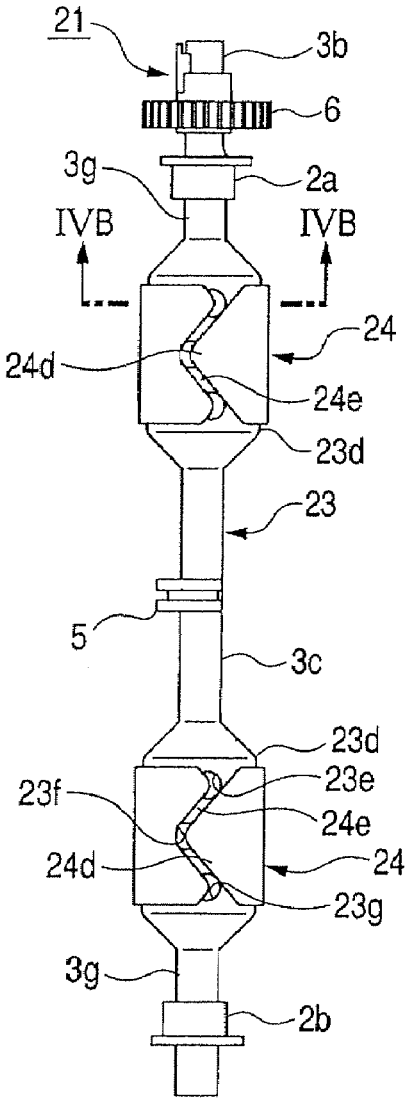
FIG. 4A is a plan view of a sheet conveying roller of a third embodiment.
Figure 4B:
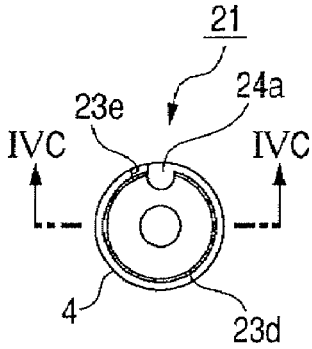
FIG. 4B is a cross sectional view taken along the line IVB-IVB in FIG. 4A.
Figure 4C:
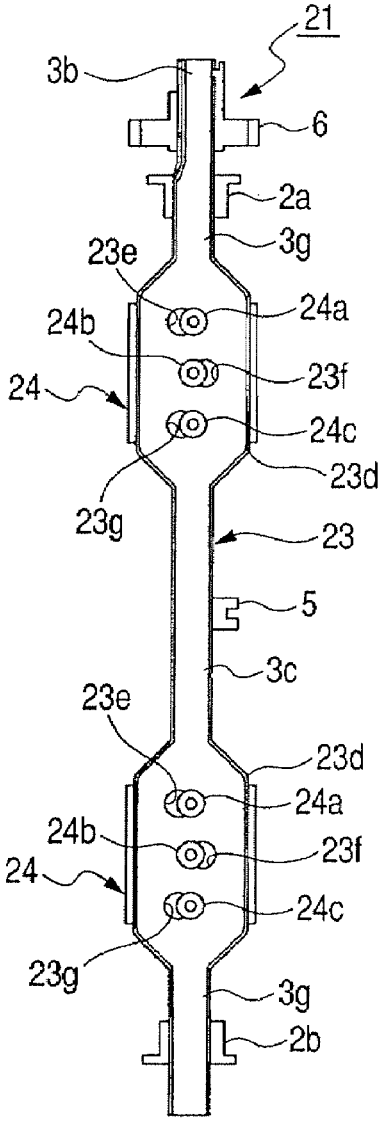
FIG. 4C is a cross sectional view taken along the line IVC-IVC in FIG. 4B.

FIGS. 4A, 4B, and 4C illustrate the sheet conveying roller of a third embodiment. FIG. 4A is a plan view of a sheet conveying roller of the third embodiment. FIG. 4B is a cross sectional view taken along the line IVB-IVB in FIG. 4A. FIG. 4C is a cross sectional view taken along the line IVC-IVC in FIG. 4B.

A sheet conveying roller 21 is structured by a pipe shaft 23 as the shaft, a rubber roller 24 as the friction member, the bearings 2*a* and 2*b*, and the gear 6. The bearings 2*a* and 2*b* and the gear 6 are not necessarily provided.

The sheet conveying roller 21 of the embodiment has a structure for easily removing the rubber roller 24 so that the sheet conveying roller 1 of the first embodiment is recyclable. The rubber roller 24 may be made of a resin instead of rubber.

The pipe shaft 23 is manufactured by similar procedure to that of the pipe shaft 3 of the sheet conveying roller 1 of the first embodiment. The pipe shaft 23 has a large-diameter portion 23*d* as the mounted portion, the small-diameter portion 3*g*, the constriction 3*c*, and the attached portion 3*b*. The sliding member 5 is fitted to the constriction 3*c* in the snap-fitting manner. Attaching holes 23*e*, 23*f*, and 23*g* are formed in the large-diameter portion 23*d* as a plurality of engaged portions.

The rubber roller 24 is mounted on the large-diameter portion 23*d* in a C-shaped cross section. On the ends of the rubber roller 24, holding projections 24*a*, 24*b*, and 24*c* are formed as the engaging portions detachably attachable to the respective attaching holes 23*e*, 23*f*, and 23*g*. The rubber roller 24 is formed in a flat plate shape, and is wound around the large-diameter portion 23*d*. The holding projections 24*a*, 24*b*, and 24*c* are engaged with the respective attaching holes 23*e*, 23*f*, and 23*g*, thus the rubber roller 24 is mounted around the large-diameter portion 23*d* in C-shaped cross section.

Utilizing the elasticity of rubber, the holding projections 24*a*, 24*b*, and 24*c* are attached to the respective attaching holes 23*e*, 23*f*, and 23*g* without looseness, so that the rubber roller 24 is closely mounted on the large-diameter portion 23*d*. As a result, the sheet conveying roller 21 can be used as a high accuracy sheet conveying roller.

The rubber roller 24 mounted around the large-diameter portion 23*d* has a chevron portion 24*d* and a valley portion 24*e* formed therein so as the opposing ends thereof to intermesh with each other. Consequently, the rubber roller 24 is mounted around the large-diameter portion 23*d* while overlapping the chevron portion 24*d* and the valley portion 24*e* with each other. With the configuration, the rubber roller 24 has no groove along the axial direction, and the sheet conveying roller 21 can convey the sheet smoothly.

The sheet conveying roller 21 of the embodiment has similar characteristics to those of the sheet conveying roller of the first embodiment illustrated in FIG. 2.

Regarding the sheet conveying roller 21 of the embodiment, when the holding projections 24*a*, 24*b*, and 24*c* are detached from the respective attaching holes 23*e*, 23*f*, and 23*g* after a long period of operation, the rubber roller 24 can be easily removed from the large-diameter portion 23*d*. Then, the pipe shaft 23 can be reused after separating the rubber roller 24 from the pipe shaft 23, which enhances the effective use of resource.

The sheet conveying roller 21 of the embodiment is further used in an assembled state in the apparatus, and even if the rubber roller 24 is damaged, the rubber roller 24 is readily replaced, which leads to easy maintenance, shortening of work time, and reduction in the parts cost.

Even with the same pipe shaft 23, the sheet conveying roller 21 of the embodiment allows replacing with a rubber roller having friction coefficient, hardness, and thickness suitable for the position of the sheet conveying roller, thus enabling the pipe shaft 23 to common use.

(Sheet Conveying Roller of the Fourth Embodiment)

Figure 5A:
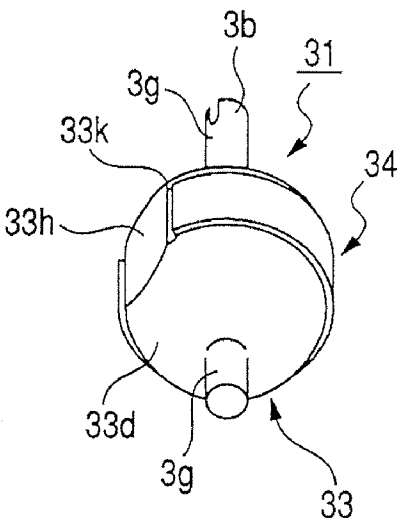
FIG. 5A is an appearance perspective view of a sheet conveying roller of a fourth embodiment.
Figure 5B:
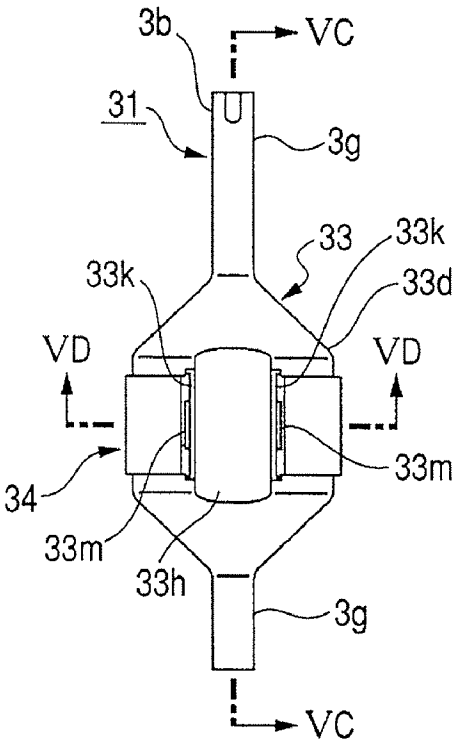
FIG. 5B is a plan view of the sheet conveying roller of the fourth embodiment.
Figure 5C:
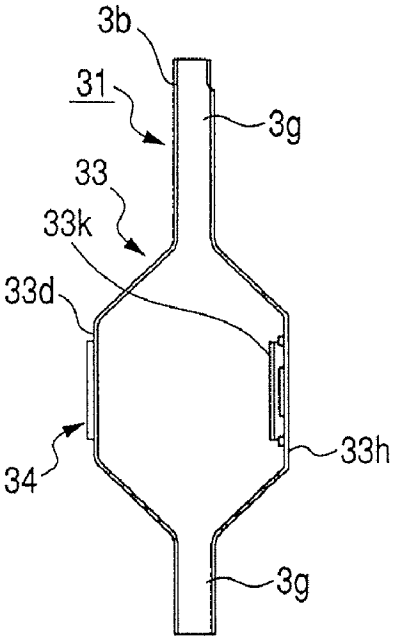
FIG. 5C is a cross sectional view taken along the line VC-VC in FIG. 5B.
Figure 5D:
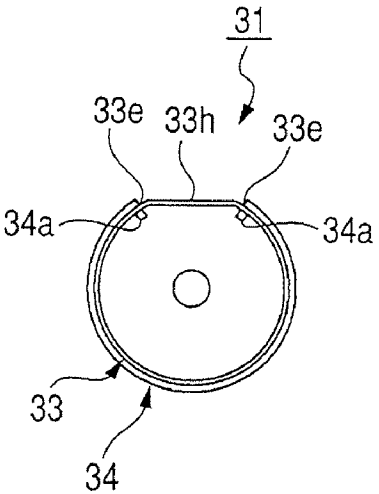
FIG. 5D is a cross sectional view taken along the line VD-VD in FIG. 5B.
Figure 6A:
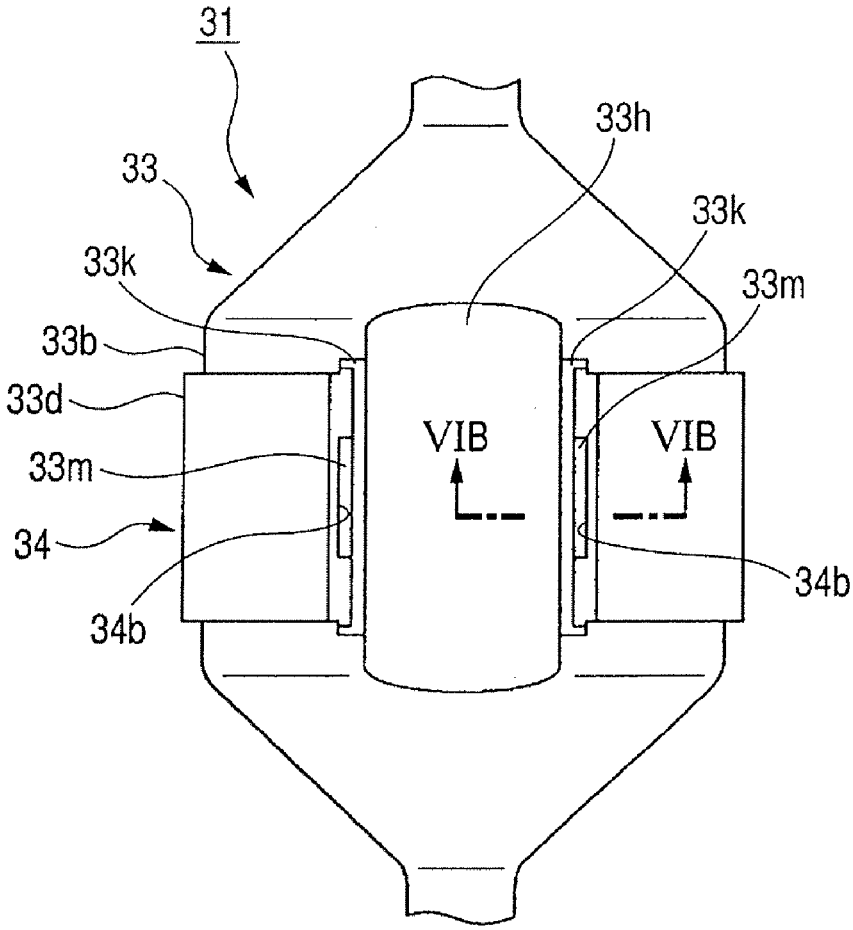
FIG. 6A is an enlarged plan view of an engaging portion of a rubber roller and a pipe shaft shown in FIG. 5A.
Figure 6B:
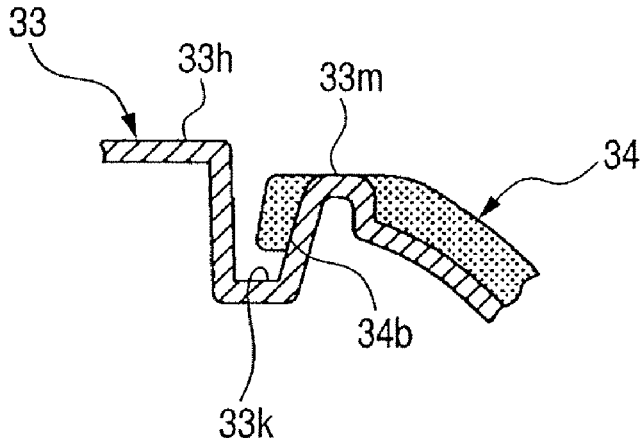
FIG. 6B is a cross sectional view taken along the line VIB-VIB in FIG. 6A.

FIGS. 5A, 5B, 5C, and 5D illustrate the sheet conveying roller of a fourth embodiment. FIG. 5A is an appearance perspective view of a sheet conveying roller of the fourth embodiment. FIG. 5B is a plan view of the sheet conveying roller of the fourth embodiment. FIG. 5C is a cross sectional view taken along the line VC-VC in FIG. 5B. FIG. 5D is a cross sectional view taken along the line VD-VD in FIG. 5B. FIG. 6A is an enlarged plan view of the engaging portion of the rubber roller and the pipe shaft as illustrated in FIG. 5A. FIG. 6B is a cross sectional view taken along the line VIB-VIB in FIG. 6A.

Also a sheet conveying roller 31 of the embodiment has a structure easy to remove a rubber roller 34 to allow the sheet conveying roller 1 to be recyclable. The rubber roller 34 may be made of a resin instead of rubber. The sheet conveying roller 31 has a large-diameter portion 33*d* as the mounted portion of a pipe shaft 33 in a D-shaped cross section so as the sheets S in the cassettes 910 and 911 to be sent out, as illustrated in FIG. 1. The large-diameter portion 33*d* is formed in D-shaped cross section to assure a distance between the sheet conveying roller 31 and the sheet.

The sheet conveying roller 31 includes the pipe shaft 33 as the shaft, a rubber roller 34 as the friction member, the bearings 2*a* and 2*b*, and the gear 6. The bearings 2*a* and 2*b* and the gear 6 are not necessarily provided.

The pipe shaft 33 is manufactured by the similar procedure to that of the pipe shaft 33 in the sheet conveying roller 1 of the first embodiment, and has the large-diameter portion 33*d*, the small-diameter portions 3*g*, and the constriction 3*b* formed therein. The large-diameter portion 33*d* is formed in a D-shaped cross section, and has a flat surface 33*h*. The flat surface 33*h* is formed to assure a distance from the sheet. To the portions corresponding to the four corners of the flat surface 33*h*, the respective attaching holes 33*e* are formed as the engaged portions.

Furthermore, grooves 33*k* are formed in parallel with the parallel edges of the flat surface 33*h*. The groove 33*k* has a projected strip 33*m* as the engaged portion along the edge of the flat surface 33*h*.

The rubber roller 34 is mounted to the large-diameter portion 33*d* in a C-shaped cross section. At an end of the rubber roller 34, a holding projection 34*a* is formed as the engaging portion detachable from the attaching hole 33*e*. In addition, at an end of the rubber roller 34, a slit hole 34*b* is formed as the engaging portion to be engaged with the projected strip 33*m*.

Utilizing the elasticity of rubber, the holding projections 34*a* are attached to the attaching holes 33*e* without looseness and the projected strips 33*m* are attached to the slit holes 34*b* without looseness, so that the rubber roller 34 is closely mounted on the large-diameter portion 33*d*. As a result, the sheet conveying roller 21 can be used as a high accuracy sheet conveying roller.

The sheet conveying roller 31 of the embodiment has similar characteristics to those of the sheet conveying roller 11 of the first embodiment.

The conventional sheet feeding roller having a large-diameter portion in a D-shaped cross section formed therein is provided with a large-diameter support rotary member, which has a solid shaft holding the sheet feeding rubber roller thereon. An endless belt or a semicircle-shape rubber roller is mounted around a circumferential portion of the large-diameter support rotary member.

To the contrary, the sheet conveying roller 31 of the embodiment is formed by mounting the rubber roller 34 around the large-diameter portion 33*d* which is formed integrally with the pipe shaft 33. Accordingly, the conventionally applied support rotary member can be eliminated to reduce the number of parts. Also, according to the embodiment, weight reduction, strength increase by the integrated structure, and improvement of shape accuracy can be achieved at once.

An end of the rubber roller 34 is locked with the projected strip 33*m* at the center portion and the slit hole 34*b* at the end center portion of the rubber roller 34. The corners of the rubber roller 34 are locked with the holding projection 34*a* and the attaching hole 33*e*. As a result, the rubber roller 34 is surely mounted on both edges of the flat surface 33*h* not interfering the sheet conveying motion.

Furthermore, even though the thickness of the rubber roller 34 is thinned to the utmost extent, the detachability of the rubber roller 34 can be assured without adversely affecting the engagement of the holding projection 34*a* and the attaching hole 33*e*, and of the projected strip 33*m* and the slit hole 34*b*.

Since the sheet conveying roller 31 has the flat surface 33*h* formed therein, the variations in torque for separating and conveying the sheet increase. The rubber roller, however, has rigidity and strength to endure the torque variations, and is mounted around the large-diameter portion 33*d*.

The sheet conveying roller 31 has a structure integrating the small-diameter portion 3*g* with the large-diameter portion 33*d* of the pipe shaft 33. Accordingly, the sheet conveying roller 31 attains sufficient strength and rigidity with a lightweight, and has very small force of inertia, thus the sheet conveying roller 31 faithfully separates and conveys the sheet. In addition, the sheet conveying roller 31 achieves the material cost reduction, the reduced torque owing to the lightweight, and the high accuracy sheet conveyance.

As described above, the sheet conveying rollers 1, 11, 21, and 31 of the embodiments are formed so as to integrate the large-diameter portions 3*d*, 13*d*, 23*d*, and 33*d* with the small-diameter portions 3*g* on the hollow pipe shafts 3, 13, 23, 33, provided therein, respectively. The large-diameter portions 3*d*, 13*d*, 23*d*, and 33*d* have the rubber rollers 4, 17, 24, and 34 with a small amount of rubber material, respectively. Therefore, the sheet conveying rollers of the embodiments solve problems including the weight reduction, torque reduction, and the problems depending on the weight by applying the sheet conveying roller to the sheet feeding roller, the sheet conveying roller, the transfer roller, and the like in an image forming apparatus, thereby manufacturing the sheet conveying roller at a low cost contributing to the resource saving. Furthermore, the sheet conveying roller provides an energy saving image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-041565, filed Feb. 17, 2006, which is hereby incorporated by reference herein in its entirety.

What is claimed is:

1. A sheet conveying roller comprising:

a shaft supported by bearings at both ends thereof; and an elastic frictional member provided on an outer circumference of the shaft, wherein the shaft is a pipe shaft, the both ends of the pipe shaft are formed into small-diameter portions, and a mount portion on which the frictional member is mounted is formed into a large-diameter portion having a diameter larger than a diameter of the both ends, wherein the sheet conveying roller conveys a sheet in contact with an outer periphery of the frictional member, at least one hole in the large-diameter portion extending through the large-diameter portion to form a passage between an inner side of the pipe shaft and an outer side of the pipe shaft, at least one projection is formed on an inner surface of the frictional member, and the at least one projection formed on the frictional member is insertable into the at least one hole in the large-diameter portion to be engaged with the at least one hole so that the frictional member is locked with the pipe shaft, wherein the frictional member is mounted on the large-diameter portion in a C-shaped cross section, while the at least one projection formed on the frictional member is detachably attached to the at least one hole in the large-diameter portion, wherein a chevron portion and a valley portion are formed on opposite ends of the C-shaped cross section of the frictional member so that the chevron portion and the valley portion intermesh with each other.

2. A sheet conveying roller according to claim 1, wherein the pipe shaft has a plurality of large-diameter portions and has an intermediate small-diameter portion between the large-diameter portions, the intermediate small-diameter portion having a diameter smaller than the diameter of the large-diameter portions.

3. A sheet conveying roller according to claim 2, wherein the intermediate small-diameter portion is supported by a supporting member.

4. A sheet conveying roller according to claim 1, wherein a flat surface is formed along an axial direction of the large-diameter portion, projected strips are formed on both sides of the flat surface, and the projection strips are engaged with the frictional member.

5. A sheet conveying roller according to claim 1, wherein the pipe shaft has a uniform wall thickness.

6. A sheet conveying apparatus comprising a sheet conveying roller, which conveys a sheet, the sheet conveying roller being a sheet conveying roller as recited in claim 1.

7. An image forming apparatus comprising:

an image forming portion configured to form an image on a sheet; and a sheet conveying roller configured to convey the sheet on which the image is formed by the image forming portion, the sheet conveying roller being a sheet conveying roller as recited in claim 1.

* * * * *